US006695725B1

(12) United States Patent
Burns, Jr.

(10) Patent No.: US 6,695,725 B1
(45) Date of Patent: Feb. 24, 2004

(54) BASEBALL HITTING-PITCHING PRACTICING DEVICE

(76) Inventor: Donald R. Burns, Jr., 2410 Mission Ridge Dr., Murfreesboro, TN (US) 37130

( * ) Notice: Subject to any disclaimer, the term of this patent is extended or adjusted under 35 U.S.C. 154(b) by 0 days.

(21) Appl. No.: 10/053,952

(22) Filed: Jan. 24, 2002

(51) Int. Cl.[7] ..... A63B 69/00
(52) U.S. Cl. ..... 473/454
(58) Field of Search ..... 473/454, 481, 473/431, 455, 421; 273/389, 394, 402; 108/59, 95; 211/107

(56) References Cited

U.S. PATENT DOCUMENTS 304,385 A * 9/1884 Weaver ..... 108/95
364,415 A * 6/1887 Hooper ..... 5/414
3,386,733 A * 6/1968 Russo et al. ..... 473/453
5,715,954 A * 2/1998 Zaremba ..... 211/107

* cited by examiner

*Primary Examiner*—Paul T. Sewell
*Assistant Examiner*—M. Chambers

(57) ABSTRACT

A baseball hitting-pitching practicing device for permitting a user to practice pitching a ball into a strike zone. The baseball hitting-pitching practicing device includes a base member that has an upper surface. An elongate support member is provided that has first and second opposed ends with the first end being mounted to the base member. The support member may extend perpendicularly away from the base member and a pair of spaced zone members is slidably mounted on a portion of the elongate support member for defining a strike zone, whereby a user pitches a baseball adjacent to the strike zone. Each of the zone members comprises a generally planar plate.

4 Claims, 2 Drawing Sheets

BASEBALL HITTING-PITCHING PRACTICING DEVICE

BACKGROUND OF THE INVENTION

1. Field of the Invention

The present invention relates to baseball hitting-pitching devices and more particularly pertains to a new baseball hitting-pitching practicing device for permitting a user to practice hitting-pitching a ball into the strike zone.

2. Description of the Prior Art

The use of baseball hitting-pitching practicing devices is known in the prior art. More specifically, baseball hitting-pitching practicing device heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,783,070; U.S. Pat. No. 4,173,337; U.S. Pat. No. 3,997,158; U.S. Pat. No. Des. 199,128; U.S. Pat. No. 5,071,122; and U.S. Pat. No. 5,087,039.

Since the start of the game baseball people have invented numerous devices to help improve their game. The devices tried to help players with the two fundamentals components of baseball, pitching and batting. The conventional devices for practicing pitching often entailed positioning a target in front of the pitcher to hit with the baseball. The conventional devices for practicing hitting a baseball often entailed a mechanical device that pitched a ball at the batter. All of these conventional devices focused on developing the pitchers' aim at hitting a particular target or training the batter to keep his eyes on the baseball. However, the conventional devices do not train a player to recognize the strike zone, which is critical to the game of baseball.

The baseball hitting-pitching practicing device according to the present invention substantially departs from the conventional concepts and designs of the prior art, and in so doing provides an apparatus primarily developed for the purpose of permitting a user to practice hitting-pitching a ball into the strike zone.

SUMMARY OF THE INVENTION

In view of the foregoing disadvantages inherent in the known types of baseball hitting-pitching practicing devices now present in the prior art, the present invention provides a new baseball hitting-pitching practicing device construction wherein the same can be utilized for permitting a user to practice hitting-pitching a ball into the strike zone.

The general purpose of the present invention, which will be described subsequently in greater detail, is to provide a new baseball hitting-pitching practicing device which has many of the advantages of the baseball hitting-pitching practicing device mentioned heretofore and many novel features that result in a new baseball hitting-pitching practicing device which is not anticipated, rendered obvious, suggested, or even implied by any of the prior art baseball hitting-pitching practicing device, either alone or in any combination thereof.

While the conventional devices fulfill their respective, particular objectives and requirements, the aforementioned patents do not disclosed a new baseball hitting-pitching practicing device. The inventive device includes a base member that has an upper surface. An elongate support member is provided that has first and second opposed ends with the first end being mounted to the base member. The support member may extend perpendicularly away from the base member and a pair of spaced zone members is slidably mounted on a portion of the elongate support member for defining a strike zone, whereby a user pitches a baseball adjacent to the strike zone. Each of the zone members comprises a generally planar plate.

It is an object of the present invention to provide a new baseball hitting-pitching practicing device which has many of the advantages of the baseball hitting-pitching practicing device mentioned heretofore and many novel features that result in a new baseball hitting-pitching practicing device which is not anticipated, rendered obvious, suggested, or even implied by any of the prior art baseball hitting-pitching practicing device, either alone or in any combination thereof.

Another object of the present invention is to provide a new baseball hitting-pitching practicing device that is positionable in a batter's box adjacent to a home plate of a baseball field. This permits a pitcher or a batter to visualize and learn the strike zone in conjunction with the home plate and the batter's box.

Still another object of the present invention is to provide a new baseball pitching practicing device that is adjustable. The present invention adjusts to define the strike zone of various sized players. Therefore, a pitcher can practice pitching in the strike zone for different batters.

Yet still another object of the present invention is to permit a coach or umpire to observe a player pitching a ball to train themselves exactly where the strike zone is located for different players.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

There has thus been outlined, rather broadly, the more important features of the baseball hitting-pitching practicing device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. It is important, therefore, that the claims be regarded as including such equivalent constructions insofar as they do not depart from the spirit and scope of the present invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
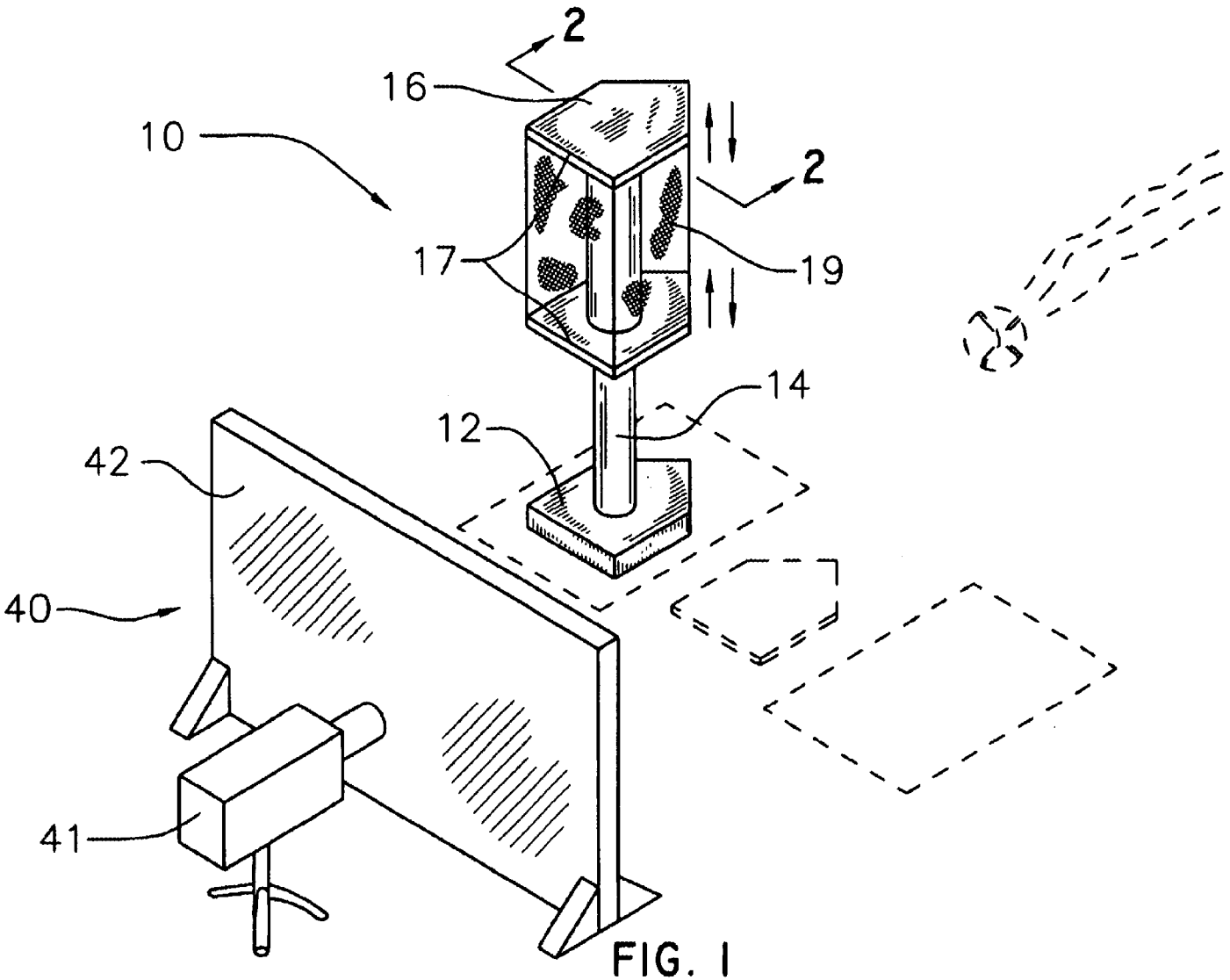
FIG. 1 is a perspective view of a new baseball hitting-pitching practicing device according to the present invention.
Figure 2:
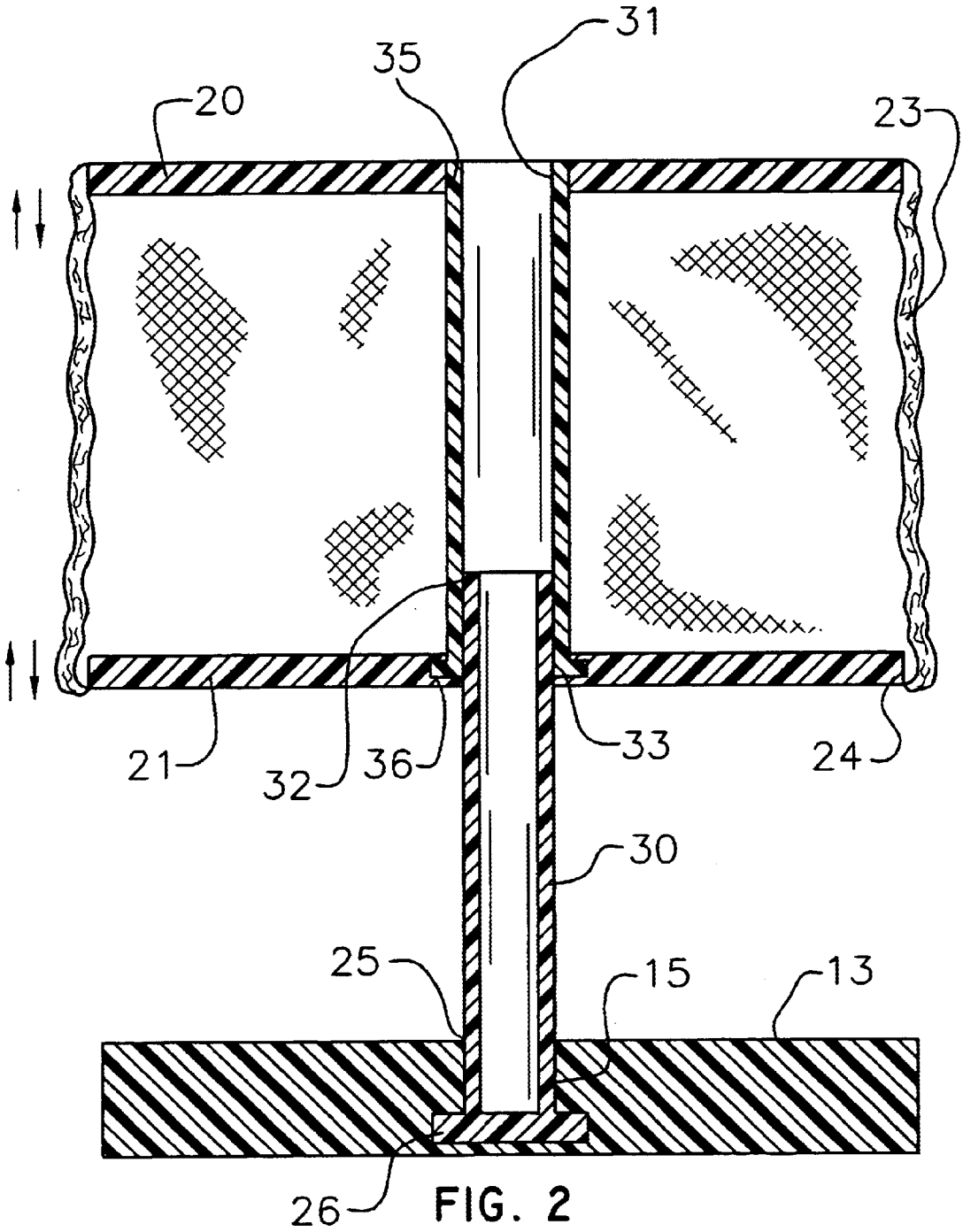
FIG. 2 is a cross sectional view of the present invention.

With reference now to the drawings, and in particular to FIGS. 1 through 2 thereof, a new baseball hitting-pitching practicing device embodying the principles and concepts of the present invention and generally designated by the reference numeral 10 will be described.

As best illustrated in FIGS. 1 through 2, the baseball hitting-pitching practicing device 10 generally comprises a base member 12 that has an upper surface 13. An elongate support member 14 is perpendicularly mounted to the upper surface 13 of the base member 12. The elongate support member 14 has first 15 and second 16 opposed ends with the first end 15 being mounted to the base member 12. A pair of spaced zone members 17 is slidably mounted on a portion of the elongate support member 14 for defining a strike zone 19 for a user to pitch a ball near.

Each of the zone members 17 may comprise a generally planar plate. Each of the plates may have a shape similar to a home plate of a baseball diamond. However, each of the zone members 17 may have any shape.

In one embodiment of the present invention, as illustrated in FIG. 2, the pair of spaced zone members 17 includes a first zone member 20 positioned generally adjacent to the second end 16 of the support member 14. A second zone member 21 positioned between the first zone member 20 and the base member 12. The space between the first 20 and second 21 zone members defines the strike zone 19.

As illustrated in FIG. 2, a covering member 23 may be coupled to and may extend between a perimeter edge 24 of the pair of spaced zone members 17. The covering member 23 may comprise a mesh material. The covering member 23 may employ a variety of colors and color schemes.

In one embodiment of the present invention, the base member 12 may comprise a generally planar plate that has a bore 25 extending perpendicularly into the upper surface 13 of the base member 12. The first end 15 of the elongate support member 14 may be mounted in the bore 25 for providing support to the elongate support member 14.

As particularly illustrated in FIG. 2, a generally annular lip 26 may be mounted to the first end 15 of the support member 14 for anchoring the support member 14 to the base member 12. Other means of anchoring the elongate support member 14 to the base member 12 may be employed.

The elongate support member 14 may have a generally circular transverse cross section taken substantially perpendicular to a longitudinal axis of the elongate support member. However, the elongate support member 14 may have any shape transverse cross section.

In one embodiment of the present invention, the elongate support member 14 may have first 30 and second 31 telescoping support portions. The first support portion 30 may be mounted to the base member 12. A first end 32 of the first support portion 30 may be telescopically disposed in an open first end 33 of the second support portion 31.

The first zone member 20 may be mounted about the second support portion 31 and may be positioned generally adjacent to a second end 35 of the second support portion 31. The second zone member 21 may be mounted about the second support portion 31 and may be positioned generally adjacent to the open first end 33 of the second support portion 31.

The second support portion 31 may have an annular lip 36 that extends away from the open first end 33 of the second support portion 31 for securing the second zone member 21 to the second support portion 31. The annular lip 36 of the second support portion 31 preferably extends into the second zone member 21.

In one embodiment of the present invention, as illustrated in FIG. 1, a recording assembly 40 may be provided for recording a user pitching a ball. The recording assembly 40 may include a means of recording 41 a user pitching a ball adjacent to the strike zone area 19. The means of recording 41 may comprise a conventional video-recording camera such as, for example, a digital or VHS camcorder. However, other types of video recording means may be employed.

The means of recording 41 may be placed upon a stand for elevating means of recording 41. The stand may comprise a tripod. However, other types of stands may also be employed.

A transparent means 42 of blocking a ball traveling toward the means of recording 41 a user pitching a ball. The transparent means 42 prevents the ball from hitting and damaging the means of recording and any other person standing behind the strike zone area 19. A plurality of leg members may be coupled to the transparent means 42 for positioning the transparent means 42 in a vertical orientation with respect to a ground surface.

The transparent means 42 may comprise a substantially transparent material such as, for example, a mesh or plastic material. Other types of transparent materials may also be employed.

In use, a user standing a distance away from the base member 12 pitches a baseball adjacent to the strike zone area 19 in order to hone their strike pitches. The base member 12 may be positioned in a batter box adjacent to a home plate of a baseball diamond. Once positioned, a batter may be in a batter box across from the base member. The batter may then observe balls being pitched with respect to the strike zone area 19, thereby teaching the batter how to determine strike pitches. After observing a few pitches a batter may then practice hitting the baseball.

The pair of zone members 17 may be adjusted along a longitudinal axis of the support member 14 for positioning the strike zone for a particular baseball league.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the baseball hitting-pitching practicing device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A baseball hitting-pitching practicing device for permitting a user to practice hitting-pitching a ball, said device comprising:

a base member having an upper surface;

an elongate support member having first and second opposed ends, said first end being mounted to said base member, said support member extending perpendicularly away from said base member; and a pair of spaced zone members being slidably mounted on a portion of said elongate support member for defining a zone for a user to pitch the ball, each of said zone members comprising a generally planar plate; and a covering member being coupled to and extending between a perimeter edge of said pair of spaced zone members.

2. The baseball hitting-pitching practicing device of claim 1, wherein said covering member comprises a mesh material of interwoven threads.

3. A baseball hitting-pitching practicing device for permitting a user to practice hitting-pitching a ball, said device comprising:

a base member having an upper surface;

an elongate cylindrical support member having first and second telescoping support portions, said first support portion being mounted to said base member, a first end of said first support portion being telescopically disposed in an open first end of said second support portion;

a first zone member being mounted about said second support portion and positioned generally adjacent to a second end of said second support portion; and a second zone member being mounted about said second support portion and positioned generally adjacent to said open first end of said second support portion, wherein said first and second zone members define a zone area for a user to pitch a ball between; and a covering member being coupled to and extending between a perimeter edge of said first and second zone members for indicating a strike zone area.

4. The baseball hitting-pitching practicing device of claim 3, wherein said covering member comprises a mesh material of interwoven threads.

* * * * *